United States Patent [19]

Back et al.

[11] 4,112,351

[45] Sep. 5, 1978

[54] DUAL THRESHOLD LOW COIL SIGNAL CONDITIONER

[75] Inventors: Paul R. Back, Somersville; Thomas G. Van Vessem, Enfield, both of Conn.

[73] Assignee: United Technologies Corporation, Hartford, Conn.

[21] Appl. No.: 829,857

[22] Filed: Sep. 1, 1977

[51] Int. Cl.[2] ..... F02P 17/00

[52] U.S. Cl. ..... 324/16 R

[58] Field of Search ..... 324/16 R, 15

[56] References Cited

U.S. PATENT DOCUMENTS

| | | | |
|---|---|---|---|
| 3,543,143 | 11/1970 | Wanninger | 324/16 R |
| 4,074,183 | 2/1978 | Voross | 324/16 R |

OTHER PUBLICATIONS

Levitre et al., Method for Ignition Breaker Points, Capacitor Testing, and Servicing Decisions, IBM Technical Disclosure Bull., 3/71, p. 3189.

*Primary Examiner*—Stanley T. Krawczewicz
*Attorney, Agent, or Firm*—M. P. Williams

[57] ABSTRACT

The end of the dwell period of a spark ignition engine is recognized by a high voltage, spark-creating swing in the low coil signal determined from comparison with a first, fixed threshold voltage which is above the current limited voltage variation of modern electronic high voltage ignition systems and a low peak primary voltage normally achieved with ignition defeat used in other diagnostic procedures. The beginning of the dwell period is sensed by comparing the low coil signal to the actual battery voltage of the engine under test; the comparison is against a substantial fraction of battery voltage which will always exceed any low coil voltage which could exist during the dwell period. False sensing of the beginning of dwell during the spark ringing time is avoided by delay circuitry which senses only those low voltage swings which exist for longer than a period of time greater than the duration of any of the low voltage excursions of the low coil ringing voltage; this delay may be subtracted with logic or by digital numeric subtraction, thereby to provide a reliable, square, conditioned low coil manifestation of vehicle low coil signals for vehicles with modern electronic high voltage ignitions as well as vehicles using the older, traditional breaker point ignition system, at high speed or slow crank, with good or bad battery and/or alternator.

3 Claims, 2 Drawing Figures

DUAL THRESHOLD LOW COIL SIGNAL CONDITIONER

BACKGROUND OF THE INVENTION

1. Field of Art

This invention relates to diagnostics of spark ignition engines, and more particularly to versatile, dual-threshold signal conditioning of a vehicle low coil signal.

2. Description of the Prior Art

As is known, the traditional breaker-point ignition system charges the primary of the high voltage coil by having the points thereof closed during the dwell period, after which the points open causing an inductive kick in the primary which in turn results in a high, ignition spark inducing voltage in the secondary of the coil for application through the distributor to the various spark plugs. The primary voltage (also called the low coil signal) thereafter rings sinusoidally until it damps out, and becomes steady at substantially the vehicle battery voltage before the points again close initiating the next dwell period. In more modern, electronically controlled, high voltage ignition systems, the electronic control over the coil primary begins at a low, near-ground potential but then rises to a potential on the order of half the battery voltage before electronic current limiting causes this voltage to remain fairly steady until the end of the dwell period; then the circuit is broken so that the inductive kick will occur in the primary to create the spark-inducing voltage of the secondary of the coil. This is followed by ringing, in the same fashion as in breaker-point ignition systems.

In prior art vehicle diagnostics, it has been known to provide an accurate measure of the dwell time (etc.) by threshold detecting the rise and fall of the low coil (or coil primary) voltage. In the past, the characteristics of the breaker-point ignition system rendered this relatively simple since a single voltage threshold (on the order of 3 or 4 volts) could be used to sense the end of the dwell period when the voltage exceeded that threshold, or the beginning of the dwell period when the voltage was reduced below that threshold. In the various modern systems, however, the voltage is initially at ground at the start of the dwell period, and may raise to some voltage varying between 3 volts and 8 volts (in normal 12 volt ignition systems) before the primary is broken to develop the inductive kick. This voltage range compares nearly identically with battery voltages which can obtain during cranking of the engine with a weak battery, which may be on the order of only 8 or 9 volts. Thus the threshold detecting is hampered not only by variations in the voltage level near the end of the dwell period for different types of high voltage, electronically-controlled systems, but also because of its similarity to the battery voltage which the coil primary assumes after its oscillatory ringing period. Also, cranking with a weak battery compared with high speed operation with a good alternator can cause the battery voltage variations of various engines to be too divergent for fixed threshold comparison.

SUMMARY OF THE INVENTION

Objects of the present invention include accommodation of a variety of different electronically-controlled high voltage ignition systems as well as the traditional breaker-point ignition systems in developing a well defined indication of the low coil signal even in cases where the battery voltage is extremely low, on the order of dwell-period voltges which may exist with strong batteries.

According to the present invention, the end of the dwell period is sensed by comparing the high voltage coil primary (low coil) voltage against a voltage reference which is between the highest steady state voltage that ignition systems to be tested thereby may assume near the end of the dwell period and the lowest primary coil voltages which may be experienced when ignition defeat is applied (such as by shunting of the coil, to permit diagnosing electrical characteristics while preventing fuel ignition). In accordance further with the invention, the beginning of the dwell period is determined by sensing the fact that the high voltage coil primary voltage has dropped to some fraction of the engine battery voltage by being compared therewith; still further, the fraction is greater than any low coil voltage which can exist during the dwell period.

The present invention accommodates various types of new as well as old ignition systems, and such systems at high speed, cranking speed, and even weak battery cranking speed and voltages. The invention can utilize circuits and technology known in the art, and may be implemented with time delays to prevent false sensing of the start of the dwell period during the ringing period. The invention accommodates a wide variety of engine styles, engine speeds, and battery voltages with a high degree of inherent reliability in formulating a well defined, conditioned manifestation of the beginning and ending of the dwell and firing periods in the high voltage coil primary winding of spark ignition engines.

The foregoing and other objects, features and advantages of the present invention will become more apparent in the light of the following detailed description of illustrative embodiments thereof, as illustrated in the accompanying drawing.

DETAILED DESCRIPTION

Figure 1:
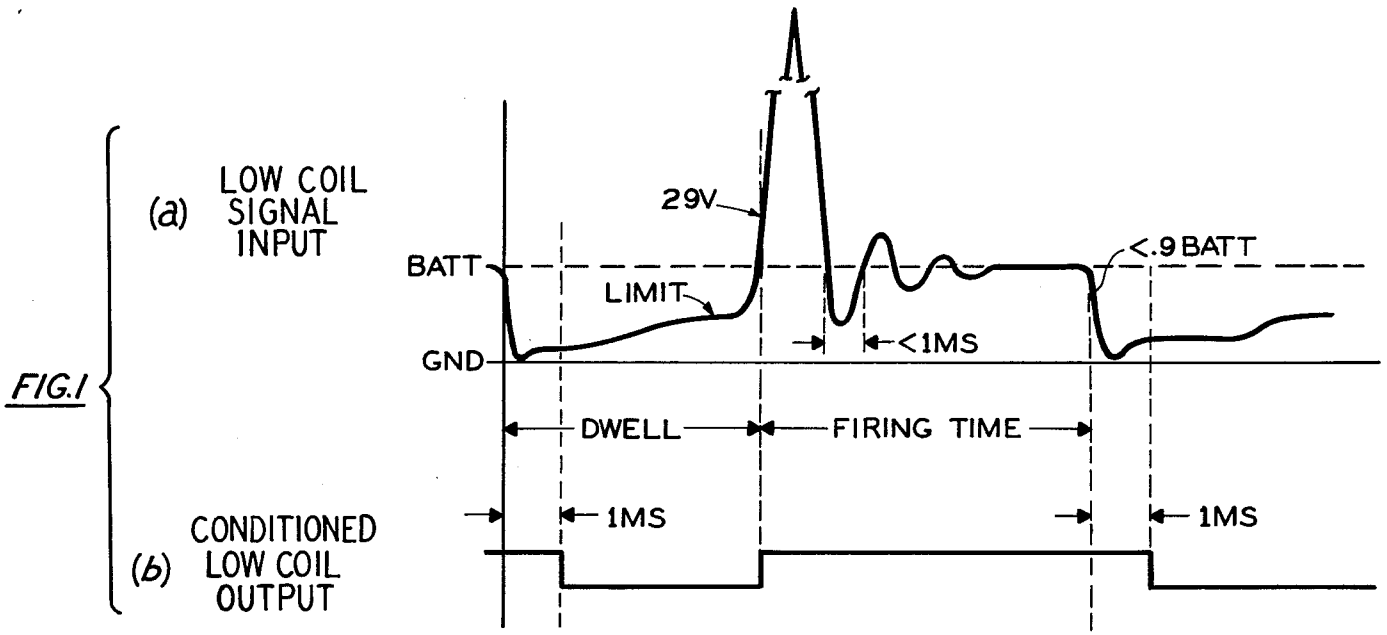
FIG. 1 is an illustration of a typical low coil signal and the well defined condition manifestation thereof produced by the invention, on a common time base.

Referring now to FIG. 1, illustration (a) shows a simplified low coil signal from a typical modern, high voltage, electronically-controlled ignition system in an electric spark engine, and illustration (b) shows the conditioned low coil output signal which the present invention provides. The difference between the low coil signal shown in illustration (a) of FIG. 1 and the low coil signal of the conventional, breaker-point ignition system is that, in the breaker-point ignition system, the dwell period is characterized by only fractional voltage once the points are closed until they are opened again at the end of the dwell period, whereas in the electronic systems, the voltage may rise above ground to a point where electronic current limiting holds the voltage at a constant value near the end of the dwell period. This voltage may vary anywhere from 2 or 3 to 8 or 9 volts in dependence upon battery condition, whether the engine is being cranked or run at low or high speeds, and the like. However, there are also variations from one ignition system to the next, both of different types and of different serial numbers of vehicles. At the end of the dwell period, the breaker points (or electronic switches) open, cutting off the current which has been established in the primary of the high voltage coil, which causes an inductive kick so that the voltage in the coil primary may rise to two or three hundred volts providing high voltage on the secondary for operating the sparks (which may be on the order of 10 or more kilovolts). There is a ringing voltage during firing time which is a damped oscillation in the coil primary, which eventually decays to essentially battery voltage toward the end of firing time. At the end of firing time the next dwell time begins by the closing of the breaker points (or electronic switches) causing the low coil voltage to go essentially to ground, to establish the primary current in the coil for the next firing, and so forth. Similar operation obtains in the high voltage systems except that breaker points aren't used, but rather electronic switches are used to control creation of the primary coil current, and the interruption thereof. In the past, where breaker point ignition systems were being diagnosed electronically, a good square wave indication of the low coil voltage, which provides an accurate measure of dwell, was obtainable simply by means of a voltage threshold circuit, operable at about 3 volts, to determine when the end of dwell period is signalled by the voltage exceeding 3 volts, and when the dwell period begins by the voltage decreasing below 3 volts. However, this type of system doesn't work with modern devices because the engine, when cranking with a weak battery may have a battery voltage on the order of 8 to 10 volts, resulting in having to sense a voltage below that as the end of firing time and the beginning of dwell time. And the battery and alternator may be in good condition and the engine may be at high rpms in which case the limit voltage in an electronic system during dwell may be on the order of 8 to 10 volts, but nearly ground in a breaker-point system. Additionally, good diagnostic systems of a modern type normally have an ignition defeat circuit, in which a resistance is shunted across the coil primary to limit the amount of ignition voltage which is produced by the high voltge coil to a value below that at which spark ignition will occur; this permits testing the electrical characteristics of the ignition system without allowing the engine to start. In such cases, the voltages across the coil primary are all reduced somewhat, so that the required threshold would be below the values of non-threshold operation which would obtain when the vehicle was operating normally. In other words, in order to provide a circuit for conditioning a low coil signal of a spark ignition engine which can accurately perform that task for different high voltage electronically-controlled ignition systems as well as breaker-point ignition systems, for engines running at high speed with a high battery voltage, for engines cranking with a weak battery at low battery voltage, for engines actually operating or engines being diagnosed with ignition defeat, the separation of the threshold becomes impossible in accordance with the prior art.

In accordance with the invention, different thresholds are used to sense the high voltage rise in the coil at the beginning of firing time and the dropping from essentially battery voltage to ground at the end of firing time. Still further, sensing of the end of firing time is done by comparing the low coil voltage against the actual battery voltage of the engine under test, rather than against a fixed standard, so that when there is a marked decrease from battery voltage, regardless of whether it is high or low battery voltage, the circuit in accordance with the invention can detect it.

As illustrated herein, the circuitry of the invention may utilize a 1 millisecond delay to avoid sensing negative swings of the damped oscillation during firing time, since the oscillations of the low coil voltage are independent of the engine speed and each of these oscillations is less than a millisecond in length. The low coil voltage must thus be substantially below battery voltage for a period of time on the order of 1 millisecond to ensure that the end of firing time (beginning of dwell time) is in fact being sensed. However, the use of this delay is known in the prior art and is only an adjunct to the present invention.

Figure 2:
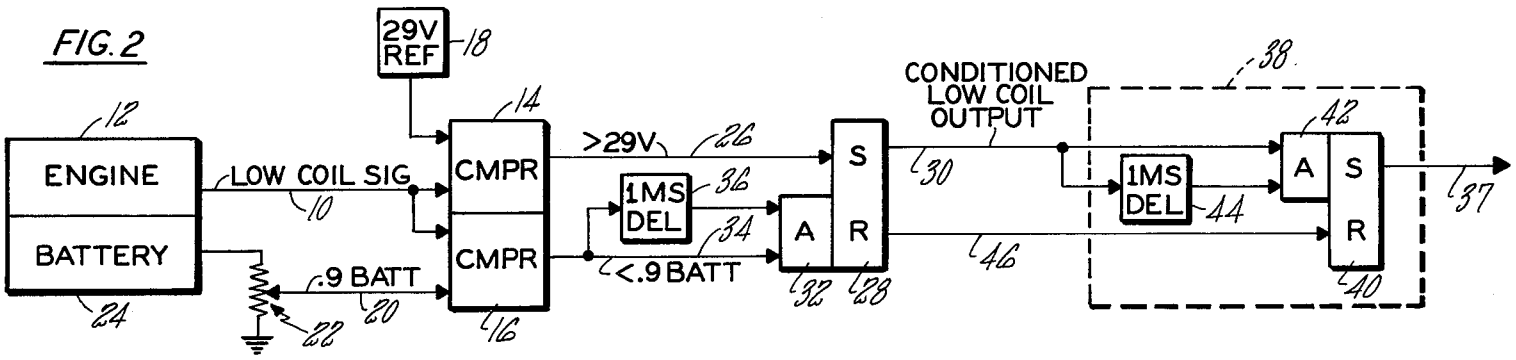
FIG. 2 is a schematic block diagram of an illustrative embodiment of the present inventin.

Referring now to FIG. 2, a low coil signal (illustration (a), FIG. 1) is fed on a line 10 from the engine under test 12 to a pair of compare circuits 14, 16 so as to provide the two distinct tests described with respect to FIG. 1 hereinbefore. The compare circuit 14 also has fed to it a fixed reference voltage, which may be on the order of 29 volts, from a reference voltage source 18, to determine when the low coil voltage has exceeded some fixed reference (such as 29 volts in the example herein) to thereby indicate the beginning of the high voltage swing at the start of firing time. The compare circuit 16 receives a signal indicative of a fraction of battery voltage (such as 9/10 of battery voltage) on a line 20, which may be provided by a voltage divider 22 connected to the battery 24 of the engine 12 under test. When the compare circuit 14 determines that the high voltage swing is underway, by providing a signal indicating greater than 29 volts on a line 26, it will set a bistable device 28, the output of which on a line 30 is a conditioned low coil output in accordance with the invention, as is shown in illustration (b) of FIG. 1. Thus, the conditioned low coil output signal on line 30 begins at the end of dwell time (at the start of firing time). Desirably, the bistable device 28 would be reset precisely at the end of firing time (the beginning of dwell time); but as described with respect to FIG. 1, in order to avoid false resettings in the middle of firing time as a result of large negative swings in the damped oscillatory voltage, it is necessary to have a delay which is greater than any of them, to ensure that the starting of the dwell period has been sensed. To this end, the bistable device 28 is reset by an AND circuit 32 only when a signal indicating less than some fraction of battery voltage, such as 9/10 of battery voltage, has been present on a line 34 for 1 millisecond as indicated by a signal from a 1 millisecond resettable delay circuit 36. The delay circuit 36 is preferably the type which may use a capacitor that is shorted out whenever the signal is not present on the line 34, but when that signal goes positive the capacitor is allowed to charge, and upon reaching some reference voltage, operates a comparator to provide the signal to the AND circuit 32. Thus, if the signal appears for a short period of time (as a consequence of ringing during firing time) but thereafter disappears, the charging of the capacitor will be interrupted and it will have to start all over again, thus precluding the delay circuit 36 from giving an input to the AND circuit 32 unless the signal is on the line 34 for the full delay period, such as 1 millisecond. However, once the start of dwell time has been sensed by the low coil voltage being less than a fraction of battery voltage for at least a millisecond, the bistable device 28 is reset by the AND circuit 32 so that the signal on the line 30 disappears. Thus, the output of the bistable device 28 on the line 30 defines the dwell and firing times of the low coil input signal from the engine except for the fact that the firing time is extended by the 1 millisecond delay, and the dwell time is commensurately diminished by that amount. This may be accommodated, in a modern digital diagnostic system, by simply subtracting from the digital values establishing firing time, a digital value commensurate with 1 millisecond in the diagnostic system, and adding a commensurate digital count to the digital word representing the dwell time. On the other hand, accommodation for almost all purposes can be made by simply delaying the start of firing time by 1 millisecond, so that the extent of the dwell time and the extent of the firing time will be accurate, even though they will be 1 millisecond delayed from the occurrence thereof in the engine. This can be accommodated by delaying a number one plug signal or any other synchronous signal by 1 millisecond so that all of the signals will be properly synchronized. Additionally, synchronization is not required for measuring the length of the dwell period, or the length of the firing period, nor is it requested for comparing the dwell period of one cylinder with that of another, and similar comparative measurements. However, to provide the millisecond delay in a simple fashion if desired, thereby to cause the dwell and firing time portions of each cycle to be of an accurate duraction in an output signal on a line 37, the converse of latch operation may be provided as illustrated by a delay compensation circuit 38, which includes a bistable device 40 settable by an AND circuit 42 only when the signal on the line 30 has been present for a full millisecond as indicated by the output of a delay circuit 44 (which is the same as the delay circuit 36). Thus there will be a delay in setting the bistable device 40 but no delay in resetting it since it is immediately reset by a signal on a line 46 from the reset side of the bistable device 28. However, this correction for the 1 millisecond delay relates to the use of 1 millisecond delay in accordance with the prior art, and solutions may be found therein; it is only an adjunct to the present invention per se.

Although illustrated herein as responding to a source of reference potential 18 on the order of 29 volts, the fixed reference potential of the source 18 may be selected to be anything which is higher than the highest possible voltage obtained during the current limited period of the dwell time, and lower than the lowest possible peak voltage of the high voltage swing on a low battery voltage engine being cranked during ignition defeat, which could be as low as 35 or 40 volts. Similarly, although the variable fraction of battery voltage used for comparison in the comparator 16 is illustrated herein as being 9/10 of the battery voltage, it can be anything suitable that is greater than the commensurate current-limited voltage during dwell time (which itself is somewhat battery dependent), sufficiently lower than battery voltage so as to be indicative of the fact that the dwell period has begun (in contrast to noise) and sufficiently high on the voltage reduction curve (see the end of firing time in illustration (a) of FIG. 1) so as to be rather fast and accurate in sensing the condition during the steeper-sloped, initial portion of the reduction from battery voltage to ground at the start of the dwell period.

The one millisecond delay herein is a period selected because it is larger than the maximum duration of the large negative swings of the damped oscillatory voltage during firing time, but small enough so as to avoid extending into the next cylinder firing time in the case of 8-cylinder engines operating at very high speed (where each cylinder sub-cycle may be on the order of a few milliseconds).

Similarly, although the circuitry herein provides a signal during firing time as shown in illustration (b) of FIG. 1, obviously the signal could be oppositely constructed so as to be present during dwell time; similarly, it should be understood that the nature of the signal provided to indicate the dwell and firing times of the ignition system is irrelevant so long as it distinguishes between these two portions of each cylinder subcycle. And, although disclosed herein as a combination of analog and discrete circuits, the invention could also be implemented with digital techniques utilizing digitized samplings of the signals, so long as provision is made to do it at high speed, without undue loss of the information from the analog signals being analyzed.

Similarly, although the invention has been shown and described with respect to an exemplary embodiment thereof, it should be understood by those skilled in the art that the foregoing and various other changes, omissions and additions may be made in and to the invention without departing from the spirit and the scope thereof, as set forth in the following claims.

Having thus described a typical embodiment of our invention, that which we claim as new and desire to secure by Letters Patent is:

1. Apparatus for generating an accurate signal representation of the dwell and firing time of a spark ignition engine comprising:

first means for comparing the low coil signal against a reference voltage which is between the highest voltage that the low coil signal can reach in the dwell period with the lowest peak voltage which the low coil signal can reach during ignition-defeated operation to provide a signal related in time to the end of a dwell period;

second means for comparing the low coil signal against a substantial fraction of the voltage of the battery of the engine to provide a signal related in time to the beginning of a dwell period; and output means responsive to said first and second comparing means for providing a signal delineating the dwell period from the firing time.

2. Apparatus according to claim 1 wherein said second means compares the low coil signal against a substantial fraction of the voltage of the battery of the engine which is determined to be greater than any magnitude which the voltage of the low coil signal can reach during the dwell period.

3. Apparatus according to claim 1 further comprising:

delay means connected for response to the output of said second means for providing a delay signal at its output in response to the continuous presence of a signal at its input for the delay period thereof; and wherein said output means includes bistable means settable into either one of two stable states, said bistable means being settable into a first one of said stable states in response to the output of said first comparing means, said bistable means being settable into the other of said stable states in response to the concurrent presence of the output of said second comparing means and the output of said delay means.

* * * * *